United States Patent [19]

Beier

[11] Patent Number: 4,841,713

[45] Date of Patent: Jun. 27, 1989

[54] METHOD FOR PACKAGING FOAM MATERIAL

[76] Inventor: John K. Beier, 901 S. 89th St., Omaha, Nebr. 68114

[21] Appl. No.: 148,334

[22] Filed: Jan. 25, 1988

[51] Int. Cl.[4] ..... B65B 11/58; B65B 31/00; B65B 61/14

[52] U.S. Cl. ..... 53/413; 53/434

[58] Field of Search ..... 53/134, 399, 413, 430, 53/434, 449, 585; 206/389, 410, 417; 220/94 R; 383/20, 21, 25, 29

[56] References Cited

U.S. PATENT DOCUMENTS

| | | | |
|---|---|---|---|
| 2,783,690 | 3/1957 | Crary et al. | 53/413 X |
| 2,982,434 | 5/1961 | Hidding | 220/94 R |
| 3,458,966 | 8/1969 | Dunbar et al. | 53/434 X |
| 4,269,322 | 5/1981 | Larson | 220/94 R |
| 4,745,727 | 5/1988 | Cinotti | 53/134 |

*Primary Examiner*—Robert L. Spruill
*Assistant Examiner*—Ann Tran
*Attorney, Agent, or Firm*—Zarley, McKee, Thomte Voorhees & Sease

[57] ABSTRACT

A method and means for packaging sheet material such as polyurethane foam is described wherein the compressed sheet material is positioned within an inner bag and is held from expansion by means of a flexible plastic sleeve with the plastic sleeve maintaining a flexible U-shaped handle between it and the bag with the handle protruding from one end of the package.

1 Claim, 6 Drawing Sheets

METHOD FOR PACKAGING FOAM MATERIAL

BACKGROUND OF THE INVENTION

This invention relates to a method and means for packaging sheet material such as polyurethane foam or the like and more particularly to a method and means for packaging the material which results in a handle being created to carry the packaged material.

The packaging of sheet material such as polyurethane foam or the like presents a problem since the material is quite bulky. At present, at least one method has been utilized to reduce the bulk of the packaged material. The sheet of foam material or the like is normally folded and then rolled into a cylinder. The cylinder of foam material is then placed in a first plastic bag. Suction or vacuum pressure is then applied to the interior of the bag to partially remove the air from the interior of the bag and the foam material which results in a compression of the material thereby reducing the diameter of the same. While maintaining suction on the first bag, a second bag, having a smaller diameter than the first bag, is slipped over the first bag having the compressed roll therein. The suction or vacuum pressure is then released and the cylinder of compressed material in the first bag will expand until restrained by the outer bag.

Two inherent problems have been encountered with one of the problems being more troublesome than the other. The first problem, which is the least troublesome, is that there is no convenient means for carrying the packaged material other than by the excess bag material at the open end or mouth of the bag. The most troublesome problem with the packaging described is that the foam material is in a compressed condition and it is difficult, if not impossible, for the prospective purchaser to ascertain the resiliency, thickness, etc. of the foam material within the package. The ability to test the resiliency, thickness, etc. of the foam material is quite important to a customer if the customer is going to use the material for a mattress pad or the like.

It is therefore a principal object of the invention to provide an improved method and means of packaging sheet material such as polyurethane foam or the like.

A further object of the invention is to provide an improved method and means for packaging foam material wherein a handle is provided for carrying the packaged material.

Still another object of the invention is to provide an improved method and means for packaging foam material wherein a handle is provided which is comprised of the same foam material contained in the bag with the foam material in the handle being in its natural state to enable a customer to determine the resiliency, thickness, etc. of the foam material.

Yet another object of the invention is to provide an improved method and means of packaging foam material which is economical of manufacture and durable in use.

SUMMARY OF THE INVENTION

In the preferred method, the foam material desired to be packaged is folded and rolled and placed in a first bag with suction then being applied to the interior of the first bag to reduce the diameter of the same. An elongated handle comprised of the same foam material contained in the bag is then placed over one end of the bag and an outer sleeve is slipped over the ends of the handle and the inner bag. The suction or vacuum pressure is then released from the interior of the bag so that the foam material within the first bag expands until restrained by the sleeve which causes the handles of the handle members to be frictionally held or pinched between the outer surface of the bag and the sleeve. In some cases, the handle may be comprised of any type of material necessary to create a handle. However, in the preferred embodiment, the handle will be comprised of the same foam material in the bag and will be enclosed by a sleeve or the like so that a prospective customer can determine the resiliency, thickness, etc. of the material within the package. A modified form of the invention is also described wherein a handle is created by inserting one end of a length of foam material into the end of the bag prior to the bag and roll being compressed. The compression of the roll maintains the handle in position. In yet another modified form of the invention, a cardboard material is positioned between the outer sleeve and the packaged material.

DESCRIPTION OF THE PREFERRED EMBODIMENT

Figure 1:
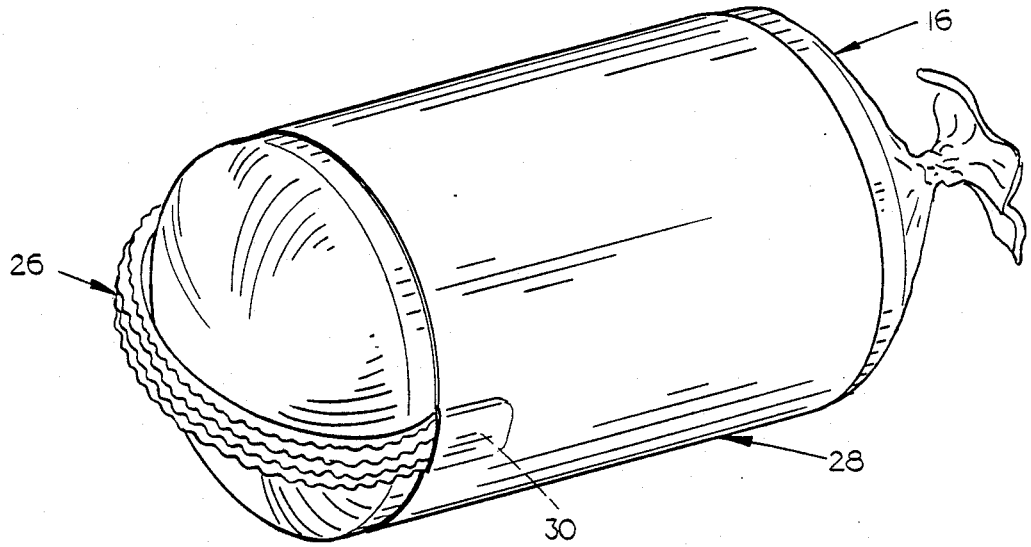
FIG. 1 is a perspective view of the package of this is a perspective view of the package of this invention.
Figure 2:
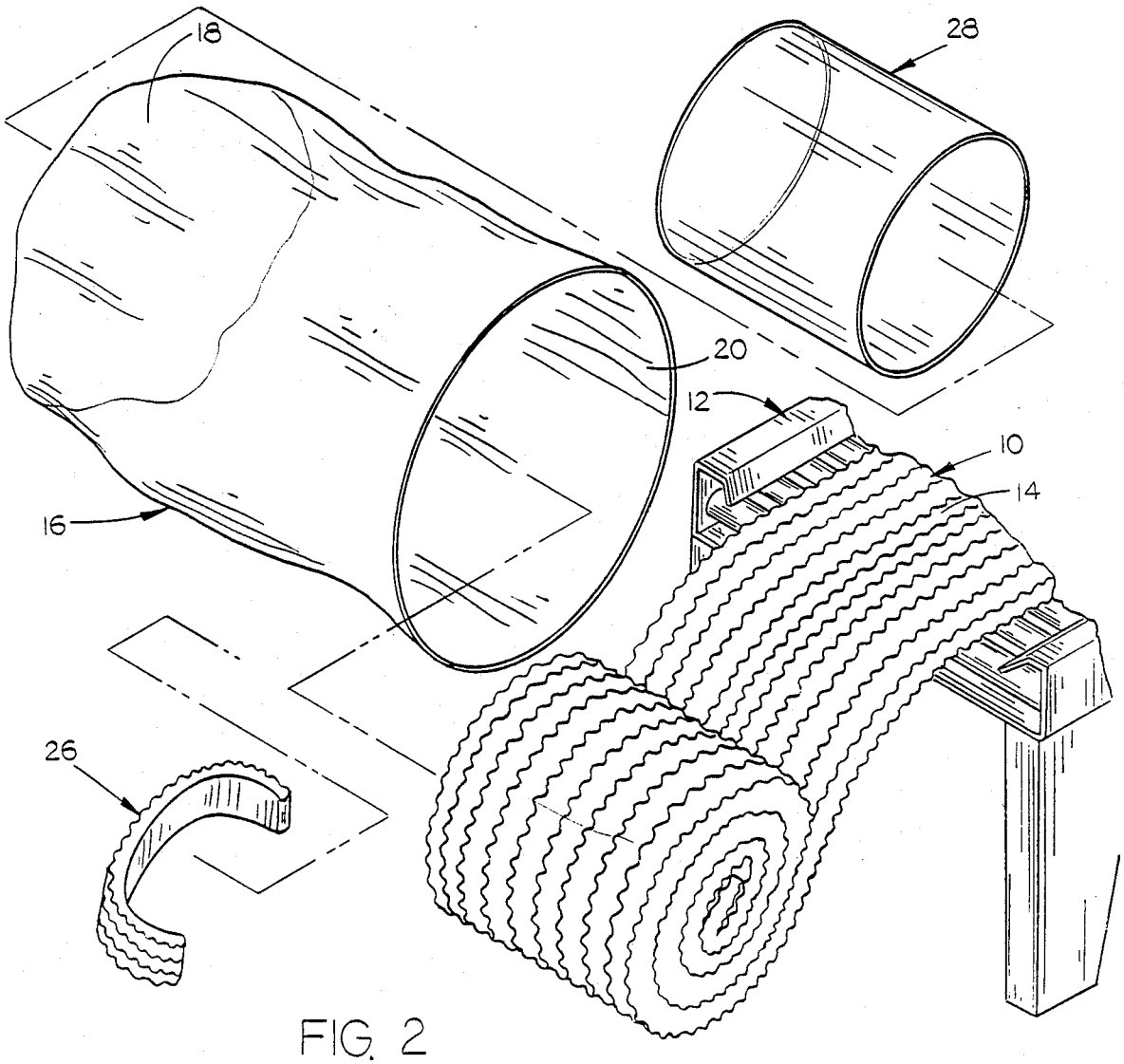
FIG. 2 is an exploded perspective view of the components of the package of this invention.

In FIG. 2, foam material 10 or the like is shown as being discharged from a conveyor 12. In FIG. 2, foam material 10 has already been folded before it is discharged from the conveyor. In most situations, the foam material will be discharged from the conveyor in wide sheets having various thickness. A cutting means is provided for cutting the sheets of foam material in the desired widths and lengths. The foam material may have relatively smooth upper and lower surfaces or it may have ridges or the like 14 provided on top and bottom surfaces thereof although the bottom surface of the foam material will normally be relatively smooth in most cases.

Figure 3:
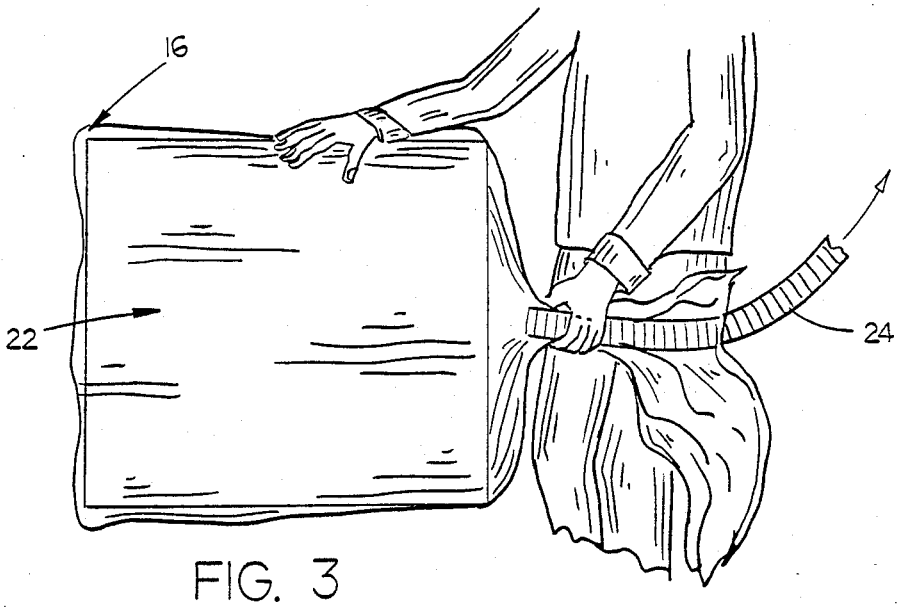
FIG. 3 is a side view illustrating the manner in which the foam material is positioned in a first bag and suction applied to the interior thereof.
Figure 4:
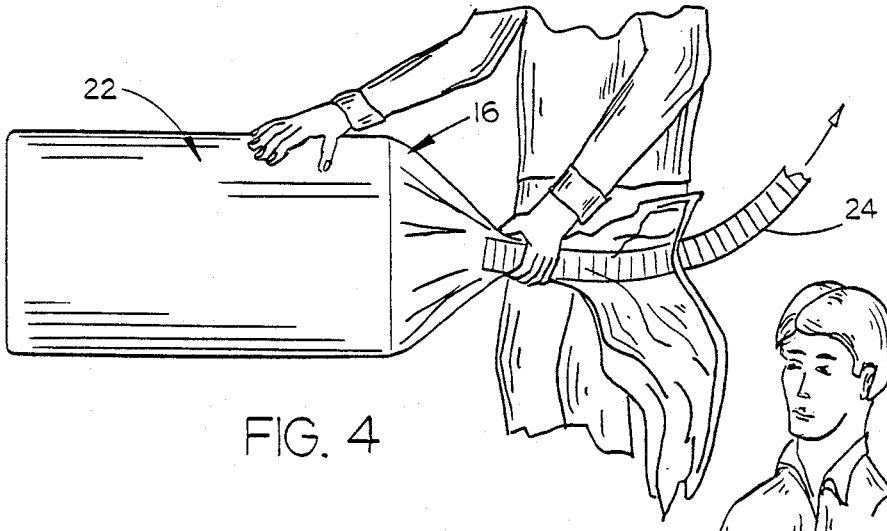
FIG. 4 is a view similar to FIG. 3 except that the diameter of the foam material within the first bag has been substantially reduced by the suction or vacuum pressure applied to the bag.

The foam material 10 is folded and rolled as illustrated in FIG. 2 and then placed in a transparent flexible plastic bag 16 having a closed end 18 and an open end or mouth 20. The roll 22 is positioned in the bag 16 as illustrated in FIG. 3. As seen in FIG. 3, when the roll 22 is initially placed in the bag 16, the roll 22 will have a diameter such that the roll will be quite bulky. In conventional fashion, a vacuum or suction tube 24 is inserted into the open end 20 of the bag and the bag brought into engagement with the exterior surface of the tube 24 as illustrated in FIG. 3. Suction is then applied through tube 24 as illustrated in FIG. 4 which draws the air from the interior of the bag 16 and from the foam material in the roll. As seen in FIG. 4, the diameter of the roll 22 is substantially decreased in conventional fashion. At this time, in conventional practice, a second bag would be placed over the compressed bag with the second bag having a much smaller diameter than the first bag so that when the suction is released from the inner bag, the inner bag can only expand until restrained by the outer bag.

Figure 5:
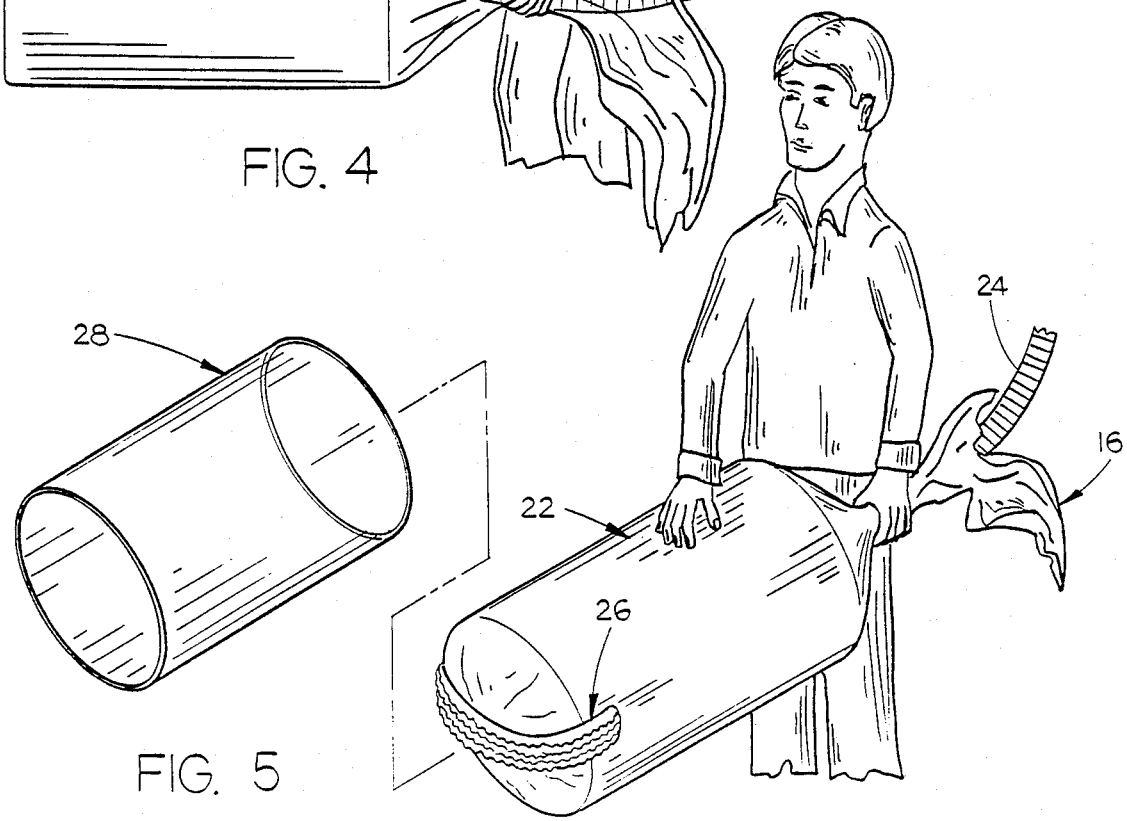
FIG. 5 is a perspective view illustrating the manner in which the handle of this invention is positioned relative to the bag of FIG. 4 with a sleeve then being positioned over the bag and handle to maintain the handle in position.
Figure 6:
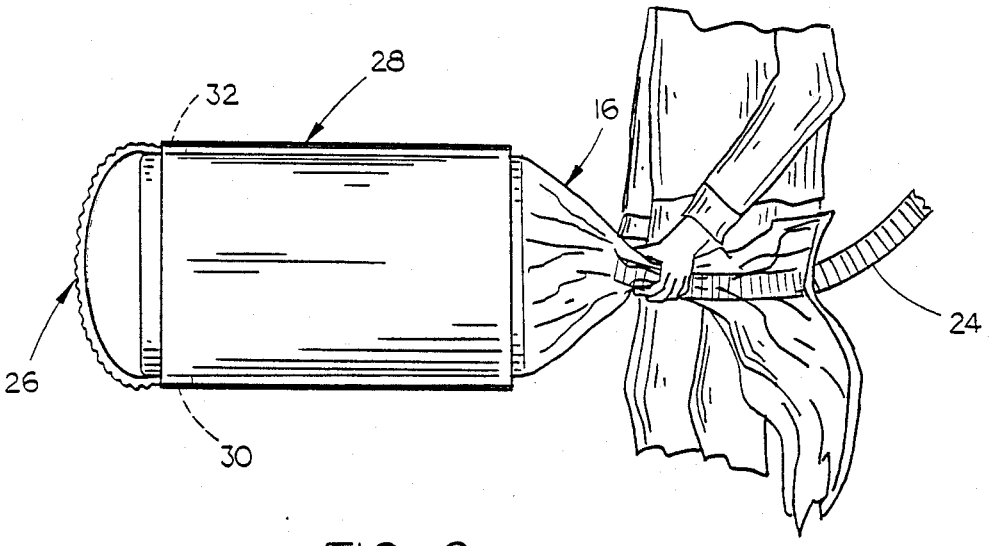
FIG. 6 is a side view similar to FIG. 4 except that it illustrates the outer sleeve and handle in position relative to the inner bag.

It is at this time that the present invention deviates from conventional practice. As seen in FIG. 5, with bag 16 in its reduced diameter state, a flexible U-shaped handle 26 is positioned adjacent the closed end of the bag 16 as illustrated. A flexible, transparent plastic sleeve 28, having a diameter much less than the normal diameter of bag 16, is then slipped over the bag 16 as illustrated in FIGS. 5 and 6 so that the ends 30 and 32 of handle 26 are positioned between the exterior surface of the bag 16 and the interior surface of sleeve 28 at one end thereof.

The closed end of the bag 16 is then opened to permit air to re-enter the interior of bag 16 and the cells of the foam material. In normal practice, suction tube 24 would be left in communication with the interior of bag 16 until this time although the drawings show that the bag 16 is being held in its closed position in a manual fashion.

Figure 7:
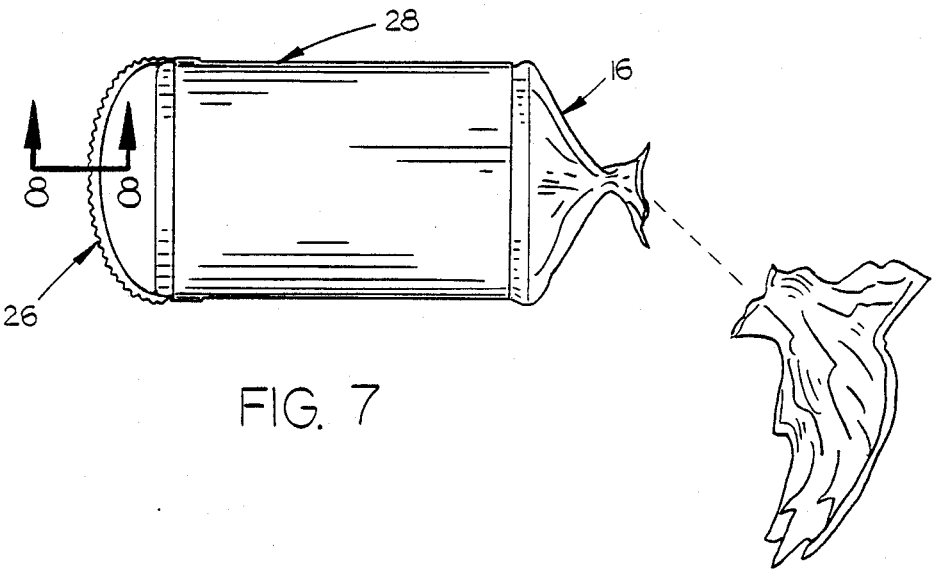
FIG. 7 is a view similar to FIG. 6 except that excess bag material has been removed from the inner bag.

When air is allowed to re-enter the interior of bag 16, the foam material will expand until restrained by the sleeve 28 thereby maintaining the roll of material in a substantially compressed condition. With the sleeve 28 restraining further expansion of the foam material, the ends of the handle 26 are positively frictionally held between bag 16 and sleeve 28. As illustrated in FIG. 7, excess material can then be cut from the end of the bag 16 if so desired.

If it is just desired to create a handle for the packaged product 30, handle 26 may be comprised of any suitable material. However, in the preferred embodiment, the handle 26 will be comprised of the same foam material as is found within the bag so that a prospective customer can feel the handle 26 to determine the resiliency, thickness, texture, etc. of the handle which will be indicative of the resiliency, thickness, texture, etc. of the material within the package which would otherwise be difficult, if not impossible, for the customer to ascertain since the foam material within the package 30 is in a highly compressed state and would not give a true indication of the quality or characteristics of the foam material.

Figure 8:
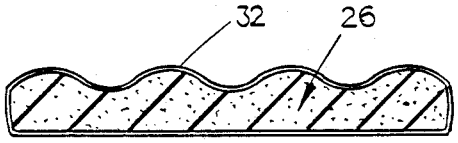
FIG. 8 is an enlarged sectional view as seen on lines 8—8 of FIG. 7.

Preferably, the handle 26, when comprised of the same foam material as within the package 30, will be encased by a flexible sleeve to create additional durability for the handle. In such a situation, the handle 26 is encased with a flexible sleeve 32 as illustrated in FIG. 8.

Thus it can be seen that a novel method and means has been described for providing a handle for packaged material with the handle providing a means for the prospective customer to determine the characteristics of the foam material within the package. In most cases, the sheet material being packaged will be comprised of a polyurethane foam but it could be comprised of foam rubber, polyurethane fiber bats, bonded polyurethane, etc.

Figure 9:
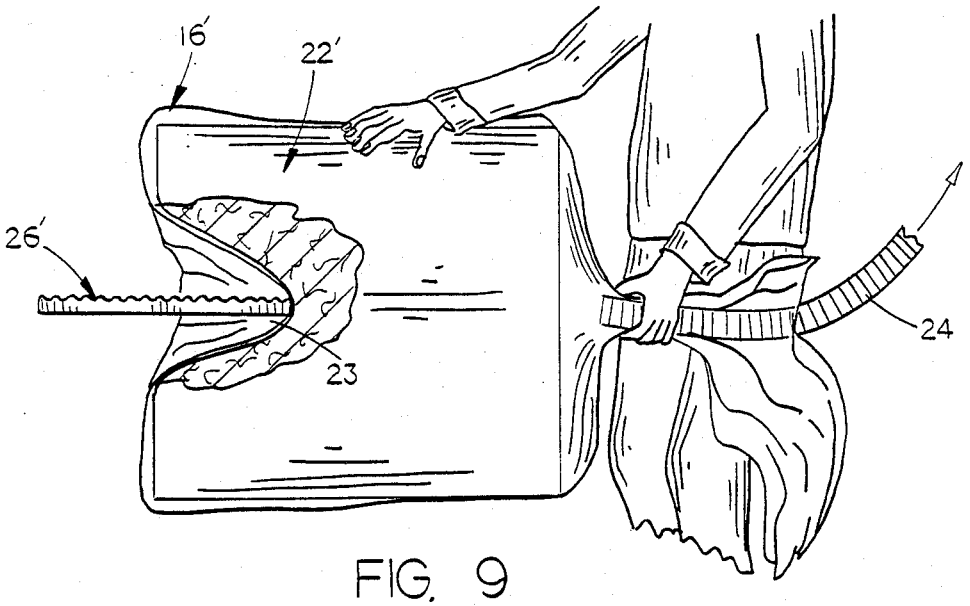
FIG. 9 is a side view of a modified form of the invention with portions thereof broken away to more fully illustrate the invention.
Figure 10:
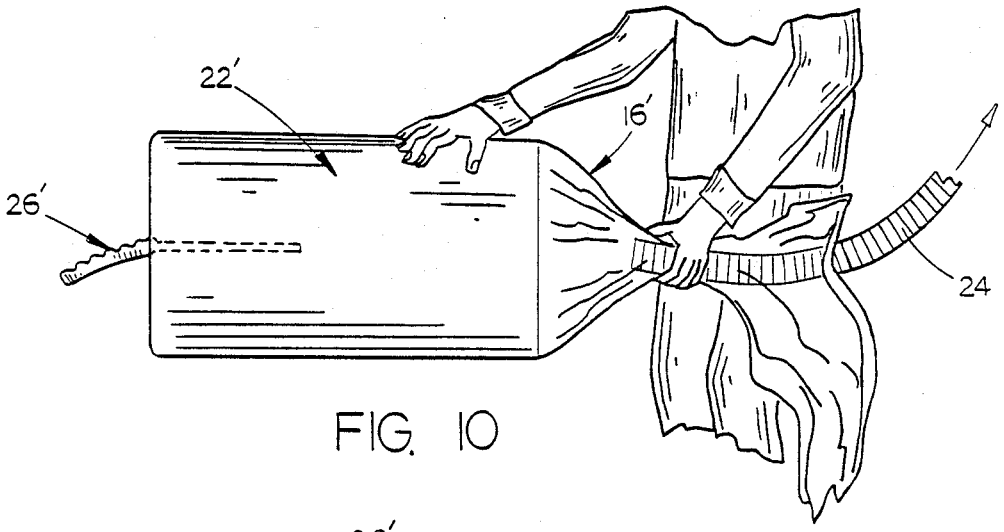
FIG. 10 is a view similar to FIG. 9 except that the roll of sheet material has been compressed through suction.
Figure 11:
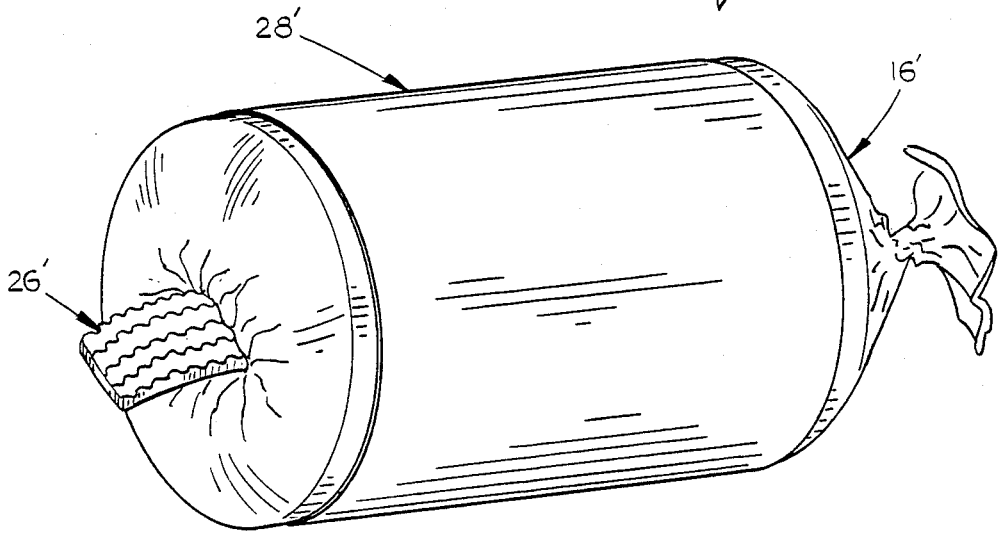
FIG. 11 is a perspective view illustrating the embodiment of FIG. 9 in its completed form.

FIGS. 9, 10 and 11 illustrate a modified form of the invention wherein a handle is created. In FIG. 9, the bag 16' is illustrated as having the roll 22' positioned therein. The closed end of the bag and one end of the roll 22' is pushed inwardly at the center thereof to create an opening 23 into which is inserted an elongated handle 26' which is comprised of the same material contained within the roll 22'. FIG. 10 illustrates the bag 16' and the roll 22' after it has been compressed through suction as in FIG. 4. The compression of the sheet 22' causes the handle 26' to be squeezed within the opening 23 thereby maintain the handle 26' in position. A sleeve simliar to sleeve 28 is then placed over the exterior of the bag 16' and the vacuum or suction is released which permits the roll 22' to expand until restrained by the sleeve 28'. In the embodiment just described, the handle 26' is held in place and protrudes from one end of the packaged product to provide a handle and to permit a prospective customer to feel the thickness, resiliency, etc. of the handle 16' which will be identical to the material contained within the roll 22'.

Figure 12:
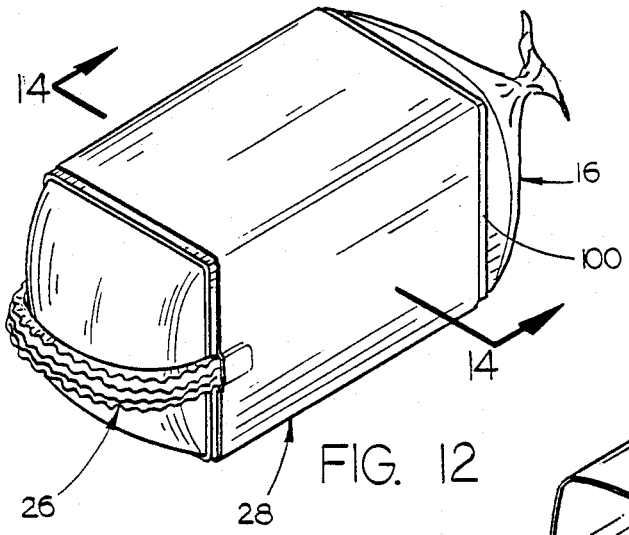
FIG. 12 is a perspective view of still another modified form of the invention.
Figure 13:
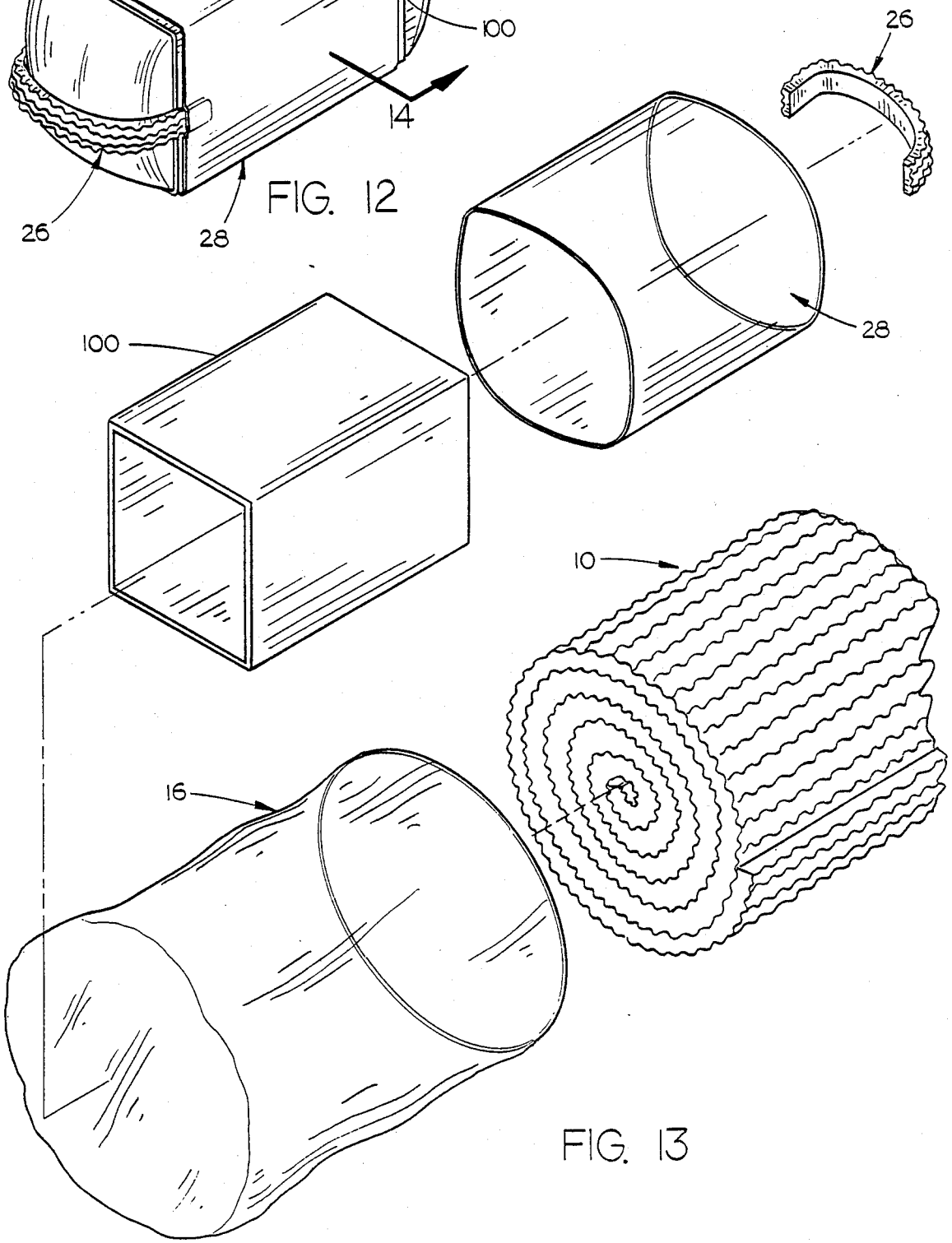
FIG. 13 is an exploded perspective view of the modified form of the invention.
Figure 14:
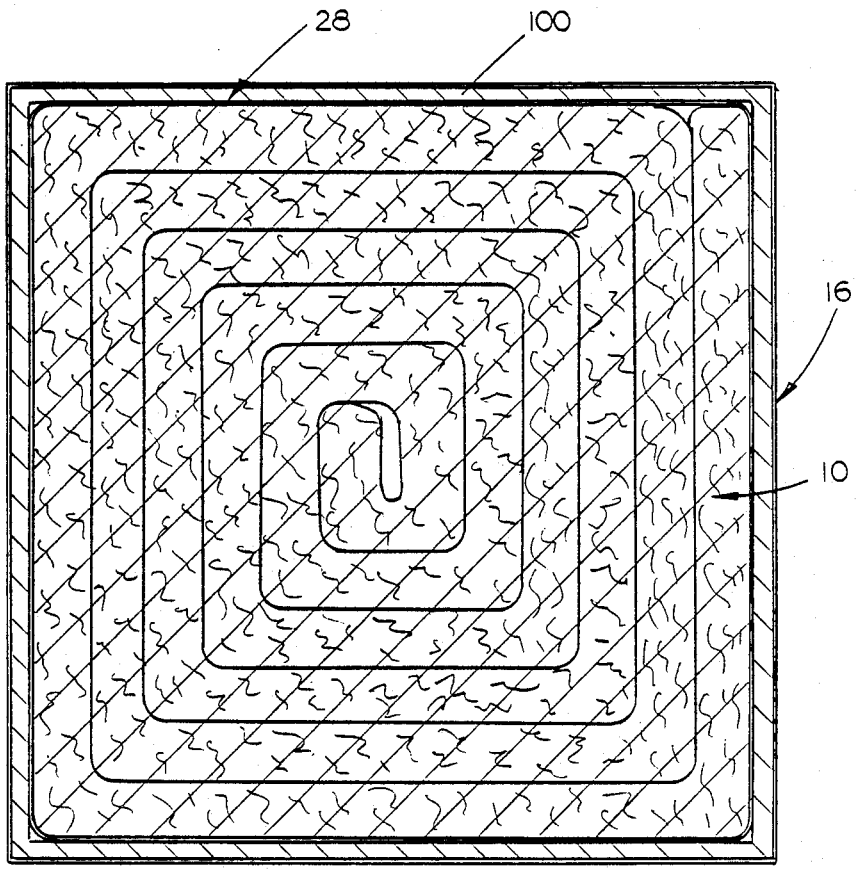
FIG. 14 is a sectional view as seen on lines 14—14 of FIG. 12.

FIGS. 12, 13 and 14 illustrate yet another modified form of the invention. The only difference between the embodiment illustrated in FIGS. 12, 13 and 14 from that of the embodiment of FIGS. 1–8 is that a strengthening member 100 comprised of a suitable cardboard paper material is positioned between the bag 16 and the sleeve 28. Preferably, member 100 has a square or rectangular configuration which will aid in not only strengthening the entire package which will also aid in stacking the packaged material, since it is easier to store square or rectangular packages than it is to store cylindrical packages. The embodiment illustrated in FIGS. 12–14 is assembled identically to that described in the embodiment of FIGS. 1–8 except that member 100 is positioned over the bag 16 after the bag 16 has been reduced in size through suction. Member 100 is then placed over bag 16 and sleeve 28 is then placed over the member 100 with the ends of the handle 26 being positioned between the interior surface of the member 100 and the exterior surface of the bag 16 at one end thereof.

When the vacuum or suction is released from bag 16, the material 10 will expand until the member 100 and sleeve 28 restrain the same from further expansion. When the embodiment of FIGS. 12–14 is utilized, the finished product is more easily stacked than cylindrical rolls.

Thus it can be seen that the invention accomplishes at least all of its stated objectives.

I claim:

1. The method of packaging sheet material, comprising the steps of:

providing a flexible plastic bag having a closed end and an open end, providing a flexible sheet member comprised of a foam material, providing a flexible first sleeve means having open ends, said first sleeve means having a diameter less than the diameter of said bag, folding the sheet member to form a roll, placing the roll into the bag, at least partially removing the air from the bag and the roll of material to compress the material thereby reducing the diameter thereof and the diameter of the bag, positioning an elongated handle means comprised of the same foam material as the flexible sheet member, relative to the bag so that the ends of the handle means are adjacent the sides of the bag adjacent the closed end thereof, placing the sleeve means around the bag so that the ends of the handle means are positioned between the bag and the sleeve means, permitting air to re-enter the interior of the bag so that the material will expand until restrained by the sleeve means with the ends of the handle means being held between the sleeve means and bag solely by frictional engagement therebetween.

* * * * *